US005509144A

United States Patent [19]

Soergel et al.

[11] Patent Number: 5,509,144

[45] Date of Patent: Apr. 23, 1996

[54] BASEBALL CAP WITH INTERCHANGEABLE LOGOS

[75] Inventors: Richard C. Soergel, 8825 Tommy Ct., San Diego, Calif. 92119; S. T. Yang, Taipei, Taiwan

[73] Assignee: Richard C. Soergel, San Diego, Calif.

[21] Appl. No.: 186,665

[22] Filed: Jan. 25, 1994

[51] Int. Cl.[6] ..... A42B 1/24

[52] U.S. Cl. ..... 2/195.1; 2/195.5; 2/209.13; 2/918

[58] Field of Search ..... 2/171, 175.1, 175.4, 2/184, 195.1, 195.5, 209.13, 918, 181.4

[56] References Cited

U.S. PATENT DOCUMENTS

| | | | |
|---|---|---|---|
| 3,131,401 | 5/1964 | Brown | 2/175.1 |
| 4,451,935 | 6/1984 | Henschel . | |
| 4,464,797 | 8/1984 | Glassman . | |
| 4,611,355 | 9/1986 | Galanto et al. | 2/918 |
| 4,662,007 | 5/1987 | Lipkin | 2/195.1 |
| 4,776,043 | 10/1988 | Coleman . | |
| 4,873,726 | 10/1989 | Tapia . | |
| 4,918,758 | 4/1990 | Rendina . | |
| 4,941,210 | 7/1990 | Konucik | 2/181.4 |
| 5,003,640 | 4/1991 | Pizzacar . | |
| 5,046,195 | 9/1991 | Koritan . | |
| 5,070,545 | 12/1991 | Tapia | 2/918 |
| 5,107,548 | 4/1992 | Dotzenrod . | |
| 5,136,726 | 8/1992 | Kellin et al. | 2/171 |
| 5,253,368 | 10/1993 | Blake | 2/918 |
| 5,276,985 | 1/1994 | Halloran | 2/209.13 |

*Primary Examiner*—Diana Biefeld
*Attorney, Agent, or Firm*—Knobbe, Martens Olson & Bear

[57] ABSTRACT

A baseball cap configured to permit different logos to be interchangeably positioned on the cap. The cap includes a crown portion and a visor. The crown portion is comprised of a plurality of panels sewed onto a rib structure and a hat band. At least one of the plurality of panels define a front face of the cap, and the visor is attached to the crown portion of the cap adjacent the front face. The two panels defining the front face of the cap are made out of pile material and other panels of the crown portion, as well as the visor, can also be made out of pile material. The logos are equipped with hook fastener material which permits them to be detachably mounted on the cap. A piece of buckram material is positioned on the inside of the crown portion adjacent the panels forming the front face of the cap to maintain the front face in a shape where it is substantially perpendicular to the visor. The pile material in the front face of the cap is sewn to the buckram material using horizontal stitching so that when the logos are removed from the front face, the front face still substantially maintains its shape relative the visor. The top center of the crown portion also includes pile material so that different buttons having hook material on one surface can be interchangeably positioned thereon.

15 Claims, 2 Drawing Sheets

BASEBALL CAP WITH INTERCHANGEABLE LOGOS

BACKGROUND OF THE INVENTION

1. Field of the Invention

The present invention generally relates to hats and is specifically concerned with a baseball cap that can be adorned with buttons and logos, such as patches bearing embroidered and/or silk screened designs, which are detachable and interchangeable.

2. Description of the Prior Art

Baseball caps are a very popular type of hat, commonly worn throughout the world. Typically, most baseball caps sport some kind of logo or design on the front face of the cap that typically includes symbols, slogans or decorative designs. Baseball caps having these kinds of logos are particularly popular as they allow the wearer to express their allegiance to sporting teams, companies, etc. and also to express their individual tastes in apparel.

Unfortunately, most logos are either sewn or printed onto the fabric of the baseball cap which limits the cap to displaying only this one logo. If the wearer wishes to display a different logo on his baseball cap, he must then purchase another cap bearing the desired logo. However, most wearers of baseball caps do not want to purchase a different cap for each logo they wish to wear. Consequently, there has been a need in the prior art for a baseball cap that has interchangeable logos.

U.S. Pat. No. 4,611,355 to Galanto et al., issued Sep. 16, 1986 addresses this particular need. Specifically this patent discloses a baseball cap where the front face and the visor, in conjunction with each other, is covered with pile material which permits different logos displaying insignias and the like, having hook fastener material as backing, to be positioned on the front face of the cap to thereby present a different appearance for the baseball cap. The hook fastener and pile material disclosed in U.S. Pat. No. 4,611,355 is the same type of hook fastener and pile material sold under the trademark "VELCRO". Similarly, U.S. Pat. No. 5,070,545 to Tapia, issued Dec. 10, 1991 also discloses a cap assembly which has a front face covered by pile material allowing logos with different designs and insignias and hook fastener material as backing, to be positioned on the front face of the cap.

However, while the baseball caps disclosed in these prior art patents permit the wearer to interchange logos, repeated changing of the logos on the front face of the cap can result in the front face of the cap becoming deformed into a shape which is undesirable. Currently, most baseball caps have a layer of stiffening material, such as buckram, underneath the front face of the cap to support the front face so that it is substantially perpendicular to the cap's visor and thereby presents a substantially square appearance for the crown of the cap and thus results in a preferred appearance for the cap. Baseball caps having this appearance are generally more popular these days than the older style of cap, e.g. the caps worn by ballplayers in the 1930's, which had a rounded front face and thereby presented a more rounded appearance.

Unfortunately, repeatedly changing logos on the prior art caps which use hook and pile fastening material, i.e., "VELCRO" material, can result in the pile material pulling away from the stiffening material and thereby spoiling the preferred square appearance of the front face of the ball cap. This problem is often exacerbated as logos which are attached to the front face of a cap with these types of fasteners can be very difficult to remove and, consequently, much force is exerted on the pile material which can result in the pile material stretching or even ripping after repeated removal of the logos.

A need therefore exists in the prior art for a baseball cap which is capable of having different interchangeable logos and the like positioned thereon without repeated interchanging of logos altering the square appearance of the front face of the ball cap.

SUMMARY OF THE INVENTION

The aforementioned need is satisfied by the present invention which is essentially comprised of a baseball cap with a crown portion having a front face and a visor attached to the crown portion adjacent the front face. A piece of stiffening material is attached to the inside of the crown portion of the cap to maintain the front face in a first position where, in one preferred embodiment of the present invention, it is substantially perpendicular to the visor. Further, at least the front face of the cap is covered by a first material which allows for attachment and removal of different interchangeable logos having a surface covered with a second material which engages with the first material to securely attach the logo to the front face of the cap. The first material on the front face of the cap is attached to the stiffening material so that attachment and removal of the different logos does not change the shape of the front face of the cap.

In one specific aspect of the present invention, the front face of the cap is covered with pile material and a logo having hook fastener material on one side is then attached to the front face of the cap. The pile material on the front face of the cap is sewn to the stiffening material on the underside of the cap so that force exerted on the pile material resulting from removal of the logo is uniformly distributed to all of the underlying stiffening material. Consequently, the pile material remains supported by the stiffening material in the desired shape relative the visor.

Further, in another aspect of the present invention, substantially the entire crown portion of the cap is covered with pile material, thereby permitting logos having hook material to be interchangeably mounted anywhere on the crown portion of the cap. Additionally, the visor of the baseball cap of the present invention can also include the pile material to also permit logos to be interchangeably positioned on the visor as well.

In yet another aspect of the present invention, the cap includes the first material or the pile material on the top of the crown portion and a button having the second material or the hook fastener material on its bottom surface is attached to the top portion of the cap. Hence the cap is configured so that a plurality of buttons having different appearances and sizes can be interchangeably positioned on the top portion of the crown of the cap to thereby create a different overall appearance for the cap.

These and other objects and advantages of the present invention will become more fully apparent from the following description and appended claims taken in conjunction with the accompanying drawings.

DETAILED DESCRIPTION OF THE PREFERRED EMBODIMENTS

Figure 1:
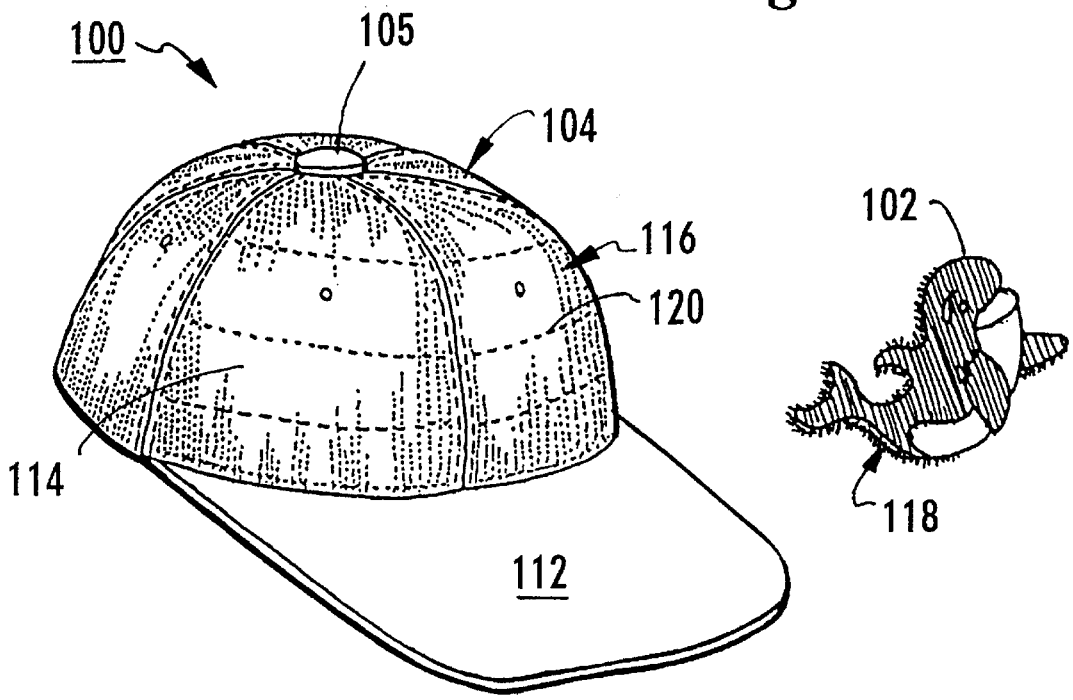
FIG. 1 is a front perspective view of one preferred embodiment of a baseball cap and detachable logo of the present invention where substantially the entire outer surface of the crown portion of the cap is comprised of pile material and one side of the logo is covered with hook fastener material.

Reference is now made to the drawings wherein like numerals refer to like parts throughout. FIG. 1 illustrates one preferred embodiment of the present invention comprised of a baseball cap 100 and an interchangeable logo 102. The baseball cap 100 has a crown portion 104 comprised of a plurality of wedge shaped panels 106 (in this case six panels are shown) which are sewn in a well known fashion to an underlying interconnected cloth rib assembly or structure 108 and a headband 110 (shown in FIG. 4). Each of the wedge shaped panels 106 meet at substantially the top center of the crown portion 104 of the cap 100 where a button 105 is positioned.

A visor 112 is connected to the crown portion 104 of the cap 100, adjacent to at least one of the six panels 106 (in this case adjacent to two of the six panels 106) so that the visor 112 extends outward from the crown portion 104. The panels 106 of the crown portion 104 adjacent the visor 112 define a front face 114 of the cap 100 upon which the interchangeable logo 102 can be positioned.

The foregoing description describes the basic structure of a typical baseball cap of the prior art. In the preferred embodiment of the present invention shown in FIG. 1, however, all of the panels 106 of the crown portion 104 of the cap are comprised of a first material 116 and one side of the logo 102 is covered with a second material 118. The first material 116 and the second material 118 can be any well known combination of material that detachably engages with one another and, in this preferred embodiment the first material 116 is preferably comprised of pile material and the second material 118 is preferably comprised of hook fastener material such as the hook and pile fastener materials sold under the trademark "VELCRO". The logo 102 can then be securely attached in any position on the crown portion 104 of the cap 100 and can subsequently be removed and replaced with a different logo to thereby create a different appearance for the cap 100. In this preferred embodiment of the present invention, the logo 102 is shown as comprising a patch in the shape of a whale, however, a person skilled in the art will appreciate that the logo 102 can consist of items other than patches including figurines, designs and the like.

Multiple lines of stitching 120 extending across the entire width of the panels 106 forming the front face 114 are also included in the baseball cap 100 of the present invention. Preferably, there are 2, 3, or 4 parallel horizontal lines of stitching joining first material 116 to a piece of stiffening material 126 (FIG. 4) positioned on the inside of the crown portion 104 of the cap 100 adjacent the front face 114. The structure and purpose of the stitching 120 and the stiffening material 126 will be described in greater detail in reference to FIG. 4 below.

Figure 2:
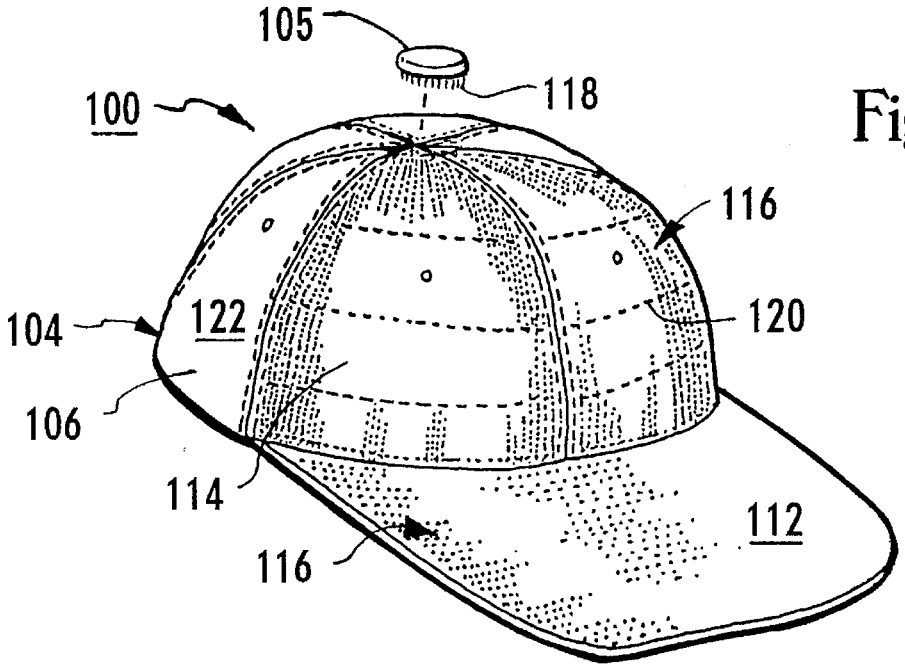
FIG. 2 is a front perspective view of the baseball cap and a detachable button of the present invention where substantially all of both the crown portion and the visor of the cap are comprised of the pile material and one side of the detachable button is covered with the hook fastener material.

As can be seen by reference to FIG. 2, different portions of the cap 100 can be comprised of the first material 116 where the logo 102 can be attached. FIG. 2 shows the baseball cap 100 wherein only the panels 106 of the front face 114 and the brim 112 include the first material 116 and the remaining four panels 106 are made out of a material 122 commonly used in baseball caps, e.g., cloth or nylon mesh. Hence, the logo 102, can only be securely positioned on the front face 114 and the brim 112 of the baseball cap 100 shown in FIG. 2. As will be appreciated, any section of the crown portion 104 or the brim 106 can be covered with the first material 116 without departing from the scope of the present invention.

Further, in FIG. 2, the button 105 is shown to be detached from the crown portion 104 of the cap 100 and the bottom surface of the button 105 is preferably covered with the second material 118. Hence, the button 105 can be interchangeably positioned on the top center of the crown portion 104 of the cap 100 provided the top center of the crown portion 104 of the cap 100 includes the first material 116. Preferably, the first material 116 on the front face 114 of the cap 100 extends up to the top center of the crown portion 114 of the cap 100 sufficiently so that the button 105 can be securely fastened thereto. Other types of fasteners, such as snaps may similarly be used to removably fasten the button 105 to the cap 100. In this preferred embodiment of the present invention, the button 105 can be interchanged with other buttons having different shapes, colors, logos, and the like, so that the wearer of the cap 100 can select from a plurality of different buttons to change the appearance of the cap 100.

Figure 3:
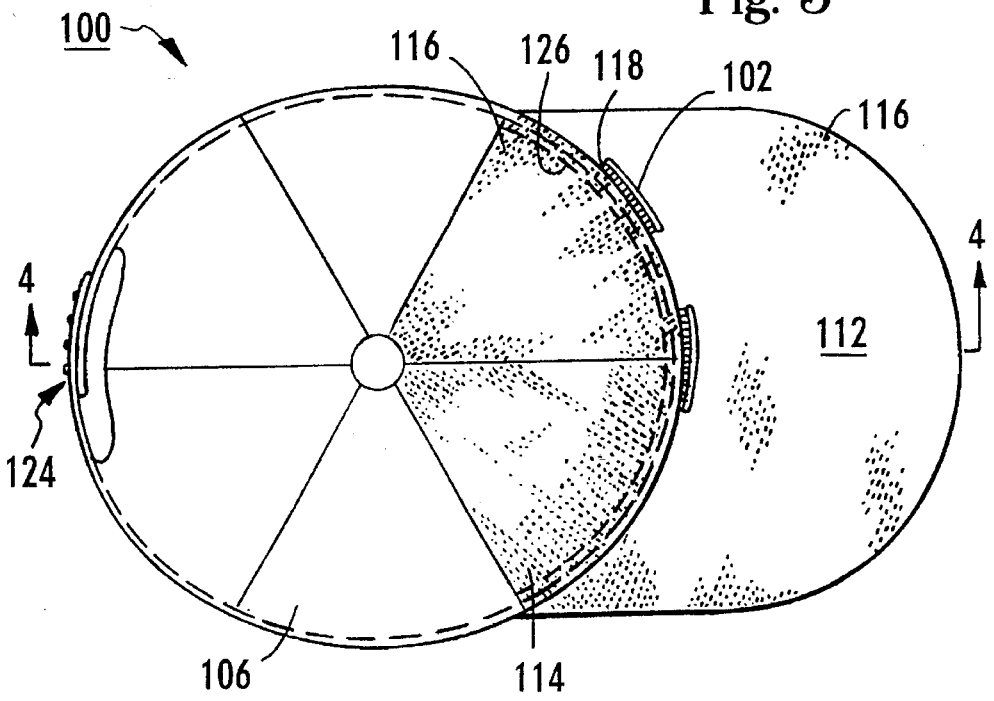
FIG. 3 is a top perspective view of another embodiment of the baseball cap and detachable logos of the present invention.

FIG. 3 is a top perspective view of the baseball cap 100 shown in FIG. 2. As can be seen, the baseball cap 100 can also be configured to have an adjustable headband 124 to permit the cap 100 to be fitted for different wearers. Further, the positioning of the button 105 at the point where each of the plurality of panels 106 join in the top center of the crown portion 104 of the cap 100 is also more clearly shown. Additionally, a plurality of logos 102 are shown being mounted on the front face 114 of the cap 100.

Figure 4:
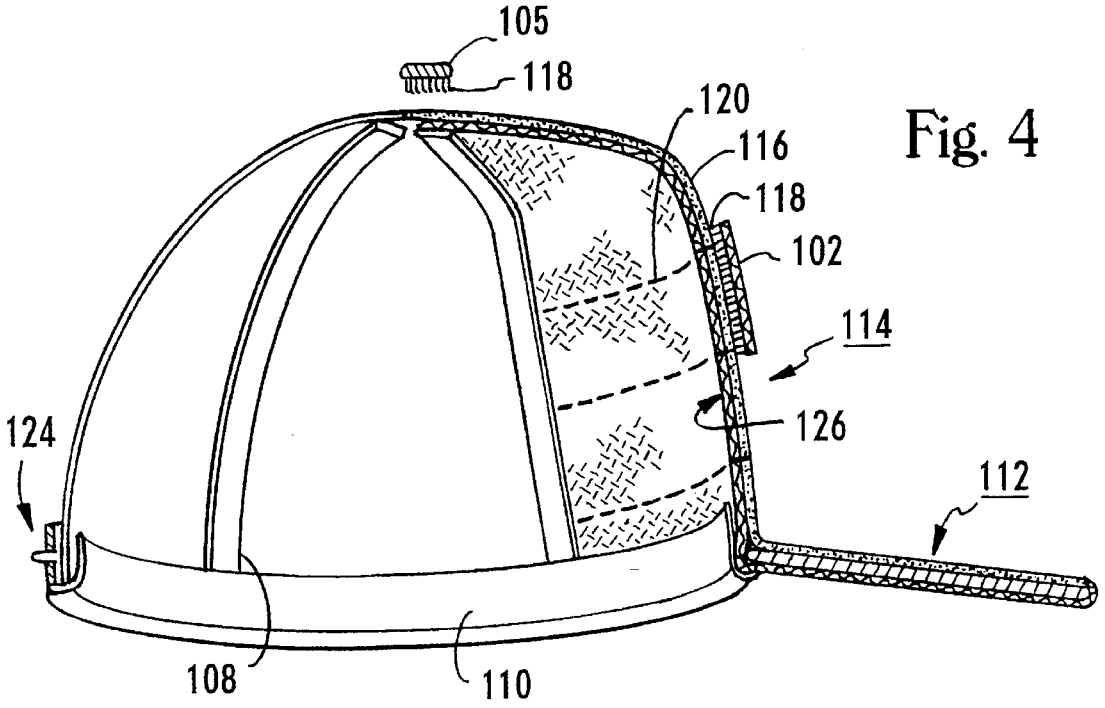
FIG. 4 is a sectional view of the cap shown in FIG. 3 taken along the lines 4—4 illustrating that the front face of the crown portion of the cap is covered with the pile material and the pile material is sewn to a layer of stiffening material attached to the inside of the cap.

FIG. 4 is a partial sectional view of the cap 100 shown in FIG. 3 which more clearly illustrates the construction of the cap 100. As mentioned above, in this preferred embodiment, the materials forming each of the panels 106 comprising the crown 104 of the cap 100 are preferably sewn to the rib assembly 108 and the headband 110 in a well known fashion to form the crown portion 104 of the cap 100. However, it can be appreciated that the panels 106 can be interconnected, or otherwise sewn together to form the crown portion 104 without requiring the rib assembly 108. Further, as also mentioned above, the material forming these panels 106 can be either cloth, nylon mesh, or any other material which is presently used to make baseball caps, as well as the first material 116.

Further, the cap 100 also includes the piece of stiffening material 126 which is attached to the headband 110 and the rib structure 108 inside the crown portion 104 of the cap 100 adjacent the two panels 106 forming the front face 114 of the cap 100. Typically, this material is a well known type of polymer mesh material known as buckram. The stiffening material 126 serves stiffen the front face 114 of the cap 100 so that the front face 114 is maintained in a supported configuration which results in the cap 100 having a substantially square profile with the front face 114 being substantially perpendicular to the visor 112, as is shown in FIG. 4.

Advantageously, in this preferred embodiment of the present invention, the first material 116 forming the panels 106 comprising the front face 114 of the cap 100 is sewn to the stiffening material 126, preferably with two three, four or more rows of horizontal stitching 120. Preferably, the first material 116 is sewn to the stiffening material 126 in such a way that when the logo 102 is removed from the first material 116 on the front face 114, the first material 116 on the front face 114 does not pull away from the stiffening material 126. Consequently, the first material 116 on the front face 114 of the cap 100 is maintained in its supported position where the front face 114 is substantially perpendicular to the visor 112 by the piece of stiffening material 126 even after repeated attachments and detachments of the logos 102. We have found that horizontal parallel rows of stitching offer advantages in preserving the shape of stiffened front face 114 and in permitting multiple attachment and removal of the logos 102.

Specifically, in the preferred embodiments of the invention shown in FIGS. 1–4, three substantially parallel lines of stitching 120 securely attach the first material 116 forming the panels 106 of the front face 114 to the stiffening material 126. Each of the three substantially parallel lines of stitching 120 extends substantially the entire width of the front face 114 across the panels 106 with one line of stitching proximate the top of the front face 114, one line of stitching proximate the bottom of the front face 114 and the third line of stitching substantially in the center of the front face 114. Preferably, when the logos 102 are removed from the front face 114, the forces applied to the front face 114 are distributed over substantially all of the stiffening material 126. Hence, sewing the front face 114 to the stiffening material 126 in this fashion minimizes the likelihood that portions of the first material 116 on the front face 114 will be pulled away from the stiffening material 126 and thereby ruin the preferred shape of the cap 100, where the front face 114 is substantially perpendicular to the visor 112, when the logos 102 are removed from the front face 114.

Although the preferred embodiment of the present invention has shown, described, and pointed out the fundamental novel features of the invention as applied to this embodiment, it will be understood that various omissions, substitutions and changes, in the form of the detail of the device illustrated, may be made by those skilled in the art, without departing from the spirit of the present invention. For example, the preferred embodiment of the present invention described the stiffening material placed being the front face of the cap to maintain a more square appearance. A person skilled in the art can appreciate that one of any number of preferred appearance of a baseball cap can be attained by different positioning of the stiffening material. Further, connecting the first material to the stiffening material in one of these different positions still results in the advantage of retaining the desired shape of the baseball cap. Consequently, the scope of the invention should not be limited to the foregoing discussion, but is to be defined by the appended claims.

What is claimed is:

1. A baseball cap having interchangeable logos comprising:

a crown portion which includes a hat band and a plurality of interconnected panels of material attached to said hat band to form said crown portion, wherein at least one of said plurality of panels of said crown portion, includes a first material and defines a front face, having a central portion and a width, of said baseball cap;

a visor attached to said crown portion adjacent said front face;

a logo having a surface covered by a second material, where said second material engages with said first material to provide releasable attachment therebetween, so that when said logo is positioned on said front face with said second material engaging with said First material, said logo is securely mounted on said front face; and a piece of stiffening material attached to said crown portion on an inside surface of said crown portion of said baseball cap adjacent said front face which maintains said front face in a first shape, wherein said first material of said front face is connected to said stiffening material by a plurality of lines of stitching which extend substantially across said width of said front face so that when said logo is removed from said front face, the force on said crown portion of said baseball cap resulting from removal of said logo is distributed to, and absorbed by, a substantial portion of the surface area of said stiffening material to thereby substantially maintain said first shape of said front face and to minimize the tendency of said first material to pull away from said stiffening material in response to repeated removals of said logo.

2. The baseball cap of claim 1, further comprising a button having a surface which includes said second material to thereby permit said button to be detachably mounted on said crown portion of said baseball cap at a location having said first material.

3. The baseball cap of claim 2, wherein said crown portion includes a piece of said first material at substantially the top center of said crown portion to permit said button to be detachably mounted on the top center of said crown portion.

4. The baseball cap of claim 1, wherein said first material is comprised of pile material and said second material is comprised of hook fastener material.

5. The baseball cap of claim 1, wherein said piece of stiffening material is comprised of buckram.

6. The baseball cap of claim 1, wherein said front face is substantially perpendicular to said brim portion of said baseball hat when said front face is maintained in said first shape.

7. The baseball cap of claim 1, wherein said front face is sewn to said stiffening material with a plurality of substantially parallel lines of stitching, each of which extend substantially the full width of said front face and wherein one of said lines of stitching is proximate the top of said front face, one of said lines of stitching is proximate the bottom of said front face and one of said lines of stitching is substantially in the center of said front face.

8. The baseball cap of claim 1, wherein each of said plurality of panels of said crown portion of said baseball cap are comprised of said first material thereby permitting said logo to be securely mounted at any location on said crown portion of said baseball cap.

9. The baseball cap of claim 1, wherein said visor of said baseball cap includes said first material to permit said logo to be securely mounted thereon.

10. A baseball cap with detachable buttons comprising:

a crown portion which includes a hat band and has an inside surface, and a plurality of substantially triangular shaped panels attached to said hat band to form said crown portion, wherein at least one of said plurality of panels includes a first material and defines a front face of said cap and a first area of said crown portion where said plurality of triangular shaped panels are positioned adjacent each other, located at substantially a top center of said crown portion, includes a third material;

a visor attached to said crown portion adjacent said at least one of the plurality of panels defining said front face;

a button detachably mounted to said top center of said cap, wherein said button is configured to have the appearance of a button fixedly attached to the top center of said crown portion of said cap, said button having a fourth material attached to a bottom surface of said button, said fourth material adapted to engage with said third material to provide releasable attachment therebetween so that said button can be detachably mounted at said top center of said crown portion of said cap;

a logo having a surface covered by a second materials, said second material adapted to engage with said first material to provide releasable attachment therebetween, so that when said logo is positioned on said front face with said second material engaging with said first material, said logo is securely mounted on said front face; and a piece of stiffening material attached to said crown portion on said inside surface of said crown portion of said baseball cap adjacent said front face which maintains said front face in a first shape, wherein said first material of said front face is connected to said stiffening material by a plurality of lines of stitching which extend substantially across said width of said front face so that when said logo is removed from said front face, the force on said crown portion of said baseball cap resulting from removal of said logo is distributed to, and absorbed by, a substantial portion of the surface area of said stiffening material to thereby substantially maintain said first shape of said front face and to minimize the tendency of said first material to pull away from said stiffening material in response to repeated removals of said logo.

11. The baseball cap of claim 10, wherein said first material is comprised of pile material and said second material is comprised of hook fastener material.

12. The baseball cap of claim 10, wherein said third material and said fourth material together comprise a snap.

13. A baseball cap having interchangeable logos and buttons comprising:

a crown portion which includes a hat band and a plurality of substantially triangular shaped panels attached to said hat band to form said crown portion, wherein at least one of said plurality of panels, includes a first material and defines a front face having a central portion and, a width, of said cap, and a top center position on said crown portion, where said plurality of triangular shaped panels are positioned adjacent each other, also includes said first material;

a visor attached to said crown portion adjacent said at least one of said plurality of panels defining said front face;

a button configured to have the appearance of a button fixedly attached to the top center of said crown portion of said cap having a second material mounted on a bottom surface of said button, wherein said second material engages with said first material to provide releasable attachment therebetween so that said button can be detachably mounted at said top center of said crown portion of said cap;

a logo, which includes a surface covered by said second material, so that when said logo is positioned on said front face with said second material engaging with said first material, said logo is securely mounted on said front face;

a piece of buckram material attached to said crown portion on an inside surface of said crown portion of said baseball cap adjacent said at least one panel of said plurality of panels defining said front face which maintains said front face in a first shape, wherein said front face is substantially perpendicular to said visor, said first material of said front face further being connected to said buckram material by a plurality of substantially parallel lines of stitching extending substantially across said width of the central portion of said front face so that, when said logo is removed from said front face, the force on said first material resulting from removal of said logo is distributed to and absorbed by, a substantial portion of the surface area of said buckram material to thereby substantially maintain said first shape of said front face of said baseball cap and to minimize the tendency of said first material to pull away from said buckram material in response to repeated removals of said logo.

14. The cap of claim 13, wherein said first material is comprised of pile material and said second material is comprised of hook fastener material.

15. The cap of claim 13, wherein each of said plurality of panels and said visor are comprised of said first material thereby permitting said logo to be mounted on said crown portion and said visor of said cap.

* * * * *